US008132727B2

(12) United States Patent
Hirabayashi et al.

(10) Patent No.: US 8,132,727 B2
(45) Date of Patent: Mar. 13, 2012

(54) CARD READER

(75) Inventors: Masahiko Hirabayashi, Nagano (JP); Katsuaki Oguchi, Nagano (JP)

(73) Assignee: Nidec Sankyo Corporation, Nagano (JP)

( * ) Notice: Subject to any disclaimer, the term of this patent is extended or adjusted under 35 U.S.C. 154(b) by 43 days.

(21) Appl. No.: 12/919,107

(22) PCT Filed: Feb. 24, 2009

(86) PCT No.: PCT/JP2009/000774

§ 371 (c)(1),
(2), (4) Date: Sep. 15, 2010

(87) PCT Pub. No.: WO2009/107353

PCT Pub. Date: Sep. 3, 2009

(65) Prior Publication Data

US 2011/0000965 A1 Jan. 6, 2011

(30) Foreign Application Priority Data

Feb. 29, 2008 (JP) ..... 2008-050543
Feb. 9, 2009 (JP) ..... 2009-026848

(51) Int. Cl.
*G06K 7/00* (2006.01)
*G06K 7/06* (2006.01)

(52) U.S. Cl. ..... 235/449; 235/486

(58) Field of Classification Search ..... 235/441, 235/486; 271/109
See application file for complete search history.

(56) References Cited

FOREIGN PATENT DOCUMENTS

| | | |
|---|---|---|
| JP | 62-208463 | 9/1987 |
| JP | 5-44312 | 6/1993 |
| JP | 08-315080 | 11/1996 |

OTHER PUBLICATIONS

JP 05-044312 Published Jun. 15, 1993, Machine Translation of Japanese Published Application.*

* cited by examiner

*Primary Examiner* — Daniel Hess
(74) *Attorney, Agent, or Firm* — Frommer Lawrence & Haug LLP

(57) ABSTRACT

A carrying roller for a card reader including: a rubber outer peripheral member, which is roughly cylindrical, and forms the outer peripheral side of the carrying roller; and a retention member, which has an outer peripheral surface that abuts the inner peripheral surface of the outer peripheral member and retains the outer peripheral member on the inner peripheral side of the outer peripheral member. The inner peripheral surface of the outer peripheral member has a plurality of protuberances that protrude inward in the radial direction. The outer peripheral surface of the retaining member has a plurality of grooves recessed in the radial direction and engaging with the projections. The height of the projections in the radial direction is no more than 1/3.5 of the radial thickness of the outer peripheral member in sections without projections.

6 Claims, 6 Drawing Sheets

| | Conditions | | | | Speed Variation Amount (%) |
|---|---|---|---|---|---|
| | Rubber Ring's Shape | Rubber Ring's Thickness (mm) | Protruded Part's Height (mm) | Radial Direction's Hardness (degree) | |
| 1 | With Protruded Part | 3.3 | 0.5 | 74～76 | 4～6 |
| 2 | With Protruded Part | 1.75 | 0.5 | 72～73 | 5～8 |
| 3 | With Protruded Part | 3.3 | 0.5 | 67～68 | 5～7 |
| 4 | With Protruded Part | 1.75 | 1.0 | 67～70 | 7～14 |
| 5 | Without Protruded Part | 1.75 | — | 75～78 | 4～6 |

Fig. 6(A)

Model "X"

| Experiment Conditions | Carrying Roller Condition 1 | Carrying Roller Condition 5 |
|---|---|---|
| Water (Wet Card Once in Five Times) | ○ | ○ |
| Hand Cream (Put Card Once in Twenty Times) | ○ | × |
| Hand Cream (Put Card Once in Ten Times) | ○ | × |

Fig. 6(B)

Model "Y"

| Experiment Conditions | Carrying Roller Condition 1 | Carrying Roller Condition 5 |
|---|---|---|
| Water (Wet Card Once in Five Times) | ○ | ○ |
| Hand Cream (Put Card Once in Twenty Times) | ○ | ○ |
| Hand Cream (Put Card Once in Ten Times) | ○ | × |

CARD READER

The present application claims priority from PCT Patent Application No. PCT/JP2009/000774 filed on Feb. 24, 2009, which claims priority from Japanese Patent Application Nos. JP 2008-050543 filed on Feb. 29, 2008, and JP 2009-026848 filed on Feb. 9, 2009, the disclosure of which is incorporated herein by reference in its entirety.

BACKGROUND OF THE INVENTION

1. Field of the Invention

The present invention relates to a card reader which is provided with a carrying roller for carrying a card.

2. Description of Related Art

Conventionally, a card reader has been known which is provided with a magnetic head for performing reproduction of magnetic information recorded on a card or recording of magnetic information on a card (see, for example, Japanese Patent Laid-Open No. Hei 8-315080). The card reader described in Patent Literature 1 is provided, for example, with a carrying roller 101 as shown in FIGS. 7(A) and 7(B) for carrying a card in the card reader. In other words, the card reader described in Patent Literature 1 is provided, for example, with a carrying roller 101 which is structured of a rubber ring 102 that is formed in a cylindrical shape and provided with a smooth inner peripheral face 102*a* and a core member 103 having a smooth outer peripheral face 103*a* that is abutted with the inner peripheral face 102*a* of the rubber ring 102 so that the rubber ring 102 is fixed to the core member 103. In the carrying roller 101, the rubber ring 102 is commonly bonded to the core member 103 with an adhesive so that slip does not occur between the rubber ring 102 and the core member 103.

SUMMARY OF THE INVENTION

However, in the carrying roller 101 having the structure as shown in FIGS. 7(A) and 7(B), since the rubber ring 102 is fixed to the core member 103 with an adhesive, adhering process is required when the carrying roller 101 is assembled. Therefore, assembling of the carrying roller 101 is complicated and its manufacturing cost is increased. Further, an adhesive force between the rubber ring 102 and the core member 103 is easily varied. Therefore, a slip may occur between the rubber ring 102 and the core member 103 while a card is being carried and thus recording quality and reproduction quality of a card reader may be deteriorated.

In view of the problems described above, an objective of the present invention is to provide a card reader including a carrying roller which is easily assembled and capable of securing recording quality and/or reproduction quality.

In order to solve the problems, the present inventors have executed various examinations and considerations. As a result, the present inventors have found that, when an outer peripheral member made of rubber which structures an outer peripheral side of the carrying roller and a holding member which is disposed on an inner peripheral side of the outer peripheral member and holds the outer peripheral member are formed in predetermined shapes, the carrying roller is easily assembled and recording quality and/or reproduction quality of a card reader can be secured.

The present invention is based on the new findings and the present invention provides a card reader including a carrying roller which is rotated by a drive force of a drive source to carry a card. The carrying roller includes an outer peripheral member which is made of rubber and formed in a substantially cylindrical shape and which structures an outer peripheral side of the carrying roller, and a holding member which is provided with an outer peripheral face that is abutted with an inner peripheral face of the outer peripheral member and which is disposed on an inner peripheral side of the outer peripheral member and holds the outer peripheral member. In addition, the inner peripheral face of the outer peripheral member is formed with a plurality of protruded parts which protrude toward an inner side in a radial direction, and the outer peripheral face of the holding member is formed with a plurality of groove parts which are recessed toward the inner side in the radial direction and engaged with the protruded parts, and a height in the radial direction of the protruded part is set to be 1/3.5 or less of a thickness in the radial direction of a portion of the outer peripheral member where the protruded part is not formed.

Further, the card reader in the present invention is provided, for example, with a magnetic head which performs reproduction of magnetic information recorded on the card and/or performs recording of magnetic information to the card.

In the card reader in the present invention, a plurality of protruded parts is formed on the inner peripheral face of the outer peripheral member which structures an outer peripheral side of the carrying roller, and a plurality of groove parts which are engaged with the protruded parts is formed on the outer peripheral face of the holding member which structures an inner peripheral side of the carrying roller. Therefore, a slip between the outer peripheral member and the holding member is prevented by the protruded parts and the groove parts. Accordingly, a conventional adhering process is not required and the carrying roller is easily assembled.

On the other hand, when a plurality of the protruded parts is formed on the inner peripheral face of the outer peripheral member, a carrying speed of a carried card is easily varied due to effects of the protruded parts and thus recording quality and/or reproduction quality of the card reader may be deteriorated. However, in the carrying roller in the present invention, the height in the radial direction of the protruded part formed on the inner peripheral face of the outer peripheral member is set to be 1/3.5 or less of the thickness in the radial direction of the portion of the outer peripheral member where the protruded part is not formed. Therefore, in the card reader in the present invention, even when a plurality of the protruded parts is formed on the inner peripheral face of the outer peripheral member, a speed variation amount of a card is restrained to the same extent as a speed variation amount of a card when the carrying roller is used in which the inner peripheral face of the outer peripheral member is not formed with the protruded parts. As a result, according to the card reader in the present invention, recording quality and/or reproduction quality can be secured.

In the present invention, it is preferable that the height in the radial direction of the protruded part is set to be ⅙ or less of the thickness in the radial direction of the portion of the outer peripheral member where the protruded part is not formed and, in a case that hardness in the radial direction of a reference carrying roller when measured by a durometer of type-"A" specified in JISK6253 is set to be a reference hardness, hardness in the radial direction of the carrying roller when measured by a durometer of type-"A" is substantially equivalent to the reference hardness. In this case, the reference carrying roller includes a reference outer peripheral member which is made of rubber and formed in a cylindrical shape and which is provided with an inner peripheral face that is smooth and where no protruded part protruding toward the inner side in the radial direction is formed, and a reference holding member which is provided with an outer peripheral face that is smooth and abutted with the inner peripheral face of the reference outer peripheral member and where no groove part recessed toward the inner side in the radial direction is formed. The reference holding member is disposed on an inner peripheral side of the reference outer peripheral member and holds the reference outer peripheral member. According to this structure, even when a plurality of the protruded parts is formed on the inner peripheral face of the outer peripheral member, a speed variation amount of a card is restrained to the same extent as a speed variation amount of a card when the carrying roller is used in which the inner peripheral face of the outer peripheral member is not formed with the protruded parts.

In the present invention, it is preferable that a distance between the protruded parts in a circumferential direction of the outer peripheral member is smaller than the thickness in the radial direction of the portion of the outer peripheral member where the protruded part is not formed. According to this structure, a slip between the outer peripheral member and the holding member is further surely prevented by the protruded parts and the groove parts.

In the present invention, it is preferable that an end part of the groove part in an axial direction of the holding member is formed with a flange part which is abutted with an end part in the axial direction of the outer peripheral member. According to this structure, displacement of the outer peripheral member from the holding member in the axial direction is prevented.

In the present invention, it is preferable that one of the groove parts which are adjacent to each other in a circumferential direction of the holding member is formed with the flange part on one end side in the axial direction of the holding member, and the other of the groove parts which are adjacent to each other is formed with the flange part on the other end side in the axial direction of the holding member. According to this structure, in a case that the holding member is manufactured by using a die, the structure of the die can be simplified and its manufacturing cost can be reduced.

As described above, in the card reader in the present invention, the carrying roller is easily assembled and recording quality and/or reproduction quality of the card reader can be secured.

BRIEF DESCRIPTION OF THE DRAWINGS

FIGS. 6(A) and 6(B) are tables showing experiment results in which a card is carried in the card reader shown in FIG. 1 in a state that a friction coefficient of the surface of the card is lowered.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Schematic Structure of Card Reader

Figure 1:
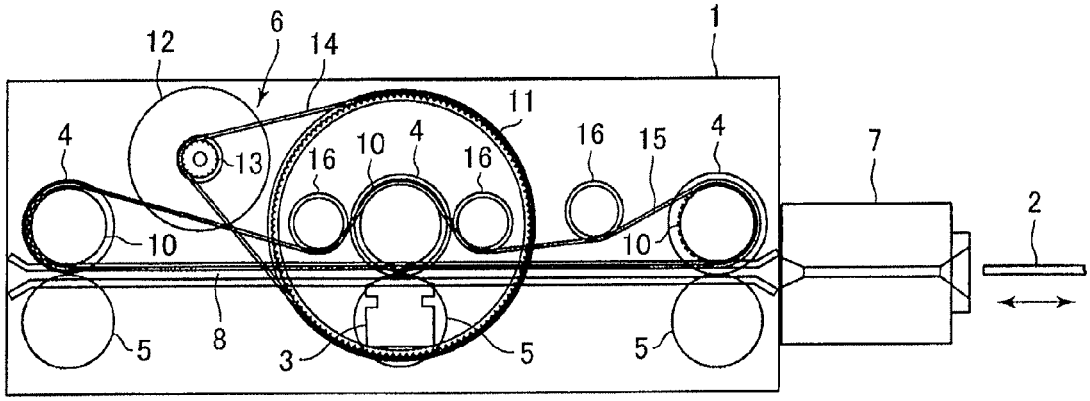
FIG. 1 is an explanatory side view showing a schematic structure of a card reader in accordance with an embodiment of the present invention.

FIG. 1 is an explanatory side view showing a schematic structure of a card reader 1 in accordance with an embodiment of the present invention.

The card reader 1 in this embodiment is a device for performing reproduction of information recorded on a card 2 and/or recording of information to a card 2. The card reader 1 includes, as shown in FIG. 1, a magnetic head 3 for performing reproduction and/or recording of magnetic information, a plurality of carrying rollers 4 for carrying a card 2 in the card reader 1, a plurality of pad rollers 5 which face the carrying rollers 4 and are urged toward the carrying rollers 4, a roller drive mechanism 6 for driving the carrying rollers 4, and a card insertion and ejection part 7 into which a card 2 is inserted and from which the card 2 is ejected. Further, a carrying passage 8 where a card 2 is carried is formed in the inside of the card reader 1.

A card 2 in this embodiment is, for example, a rectangular card made of vinyl chloride whose thickness is about 0.7-0.8 mm. A magnetic stripe (not shown) in which magnetic information is recorded is formed on a surface of the card 2. In accordance with an embodiment, an IC chip may be fixed to a surface of the card 2. The card 2 may be integrated with an antenna for communication in its inside and a printing part on which printing is performed by heat sensitive system may be formed on the surface of the card 2. Further, the card 2 may be a PET (polyethylene terephthalate) card whose thickness is about 0.18-0.36 mm, or may be a paper card having a predetermined thickness, or the like.

As shown in FIG. 1, the carrying rollers 4 are disposed on an upper side of the feeding passage 8. Further, the pad rollers 5 are disposed on a lower side of the feeding passage 8. The pad roller 5 is urged in an upper direction by an urging means not shown so as to be pressed against the carrying roller 4.

The roller drive mechanism 6 includes driven pulleys 10 which are fixed to respective rotation shafts of three carrying rollers 4, a large driven pulley 11 which is fixed to the rotation shaft of the carrying roller 4 that is disposed at the center so as to be parallel to the driven pulley 10, a drive motor 12 as a drive source for rotationally driving the carrying rollers 4, and a drive pulley 13 which is fixed to an output shaft of the drive motor 12. Further, the roller drive mechanism 6 includes a timing belt 14 which is stretched over the drive pulley 13 and the large driven pulley 11, a timing belt 15 which is stretched over the driven pulleys 10, and a plurality of tension pulleys 16 for adjusting a tensile force of the timing belt 15.

Structure of Carrying Roller

Figure 2A:
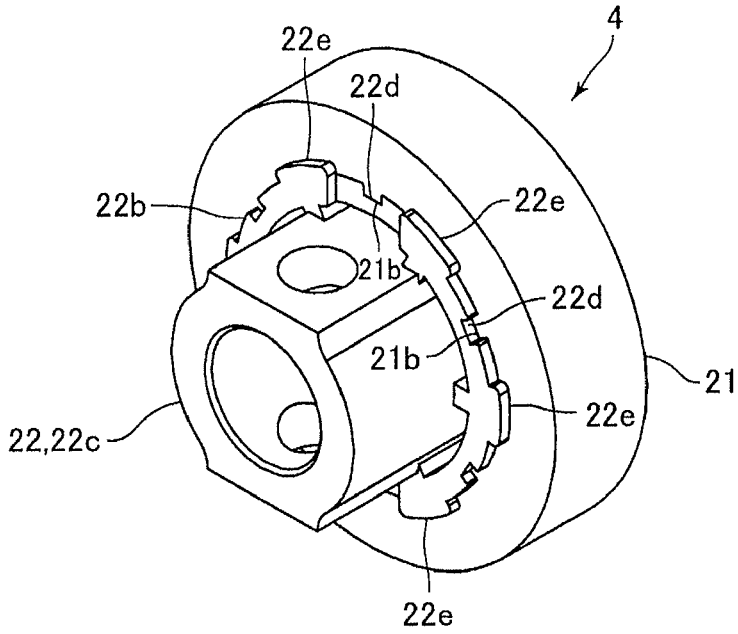
FIG. 2(A) is a perspective view showing a carrying roller shown in FIG. 1
Figure 2B:
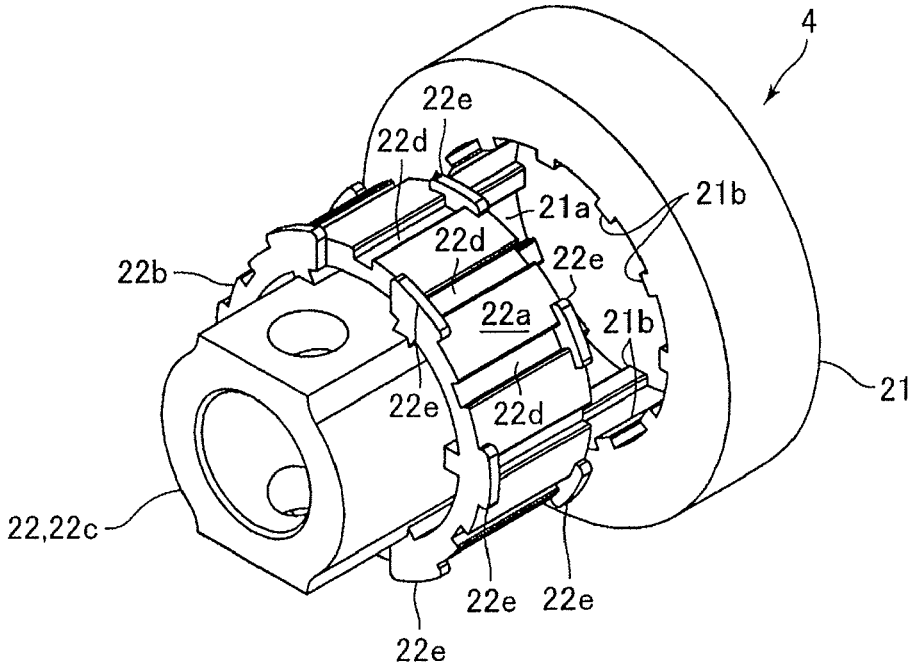
FIG. 2(B) is an exploded perspective view showing the carrying roller shown in FIG. 2(A)
Figure 3:
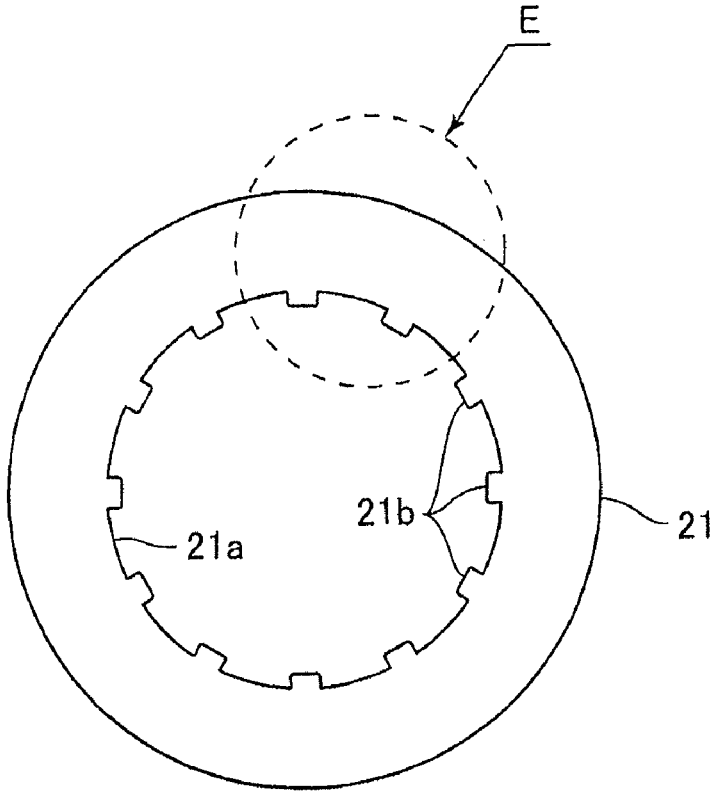
FIG. 3 is a side view showing a rubber ring shown in FIGS. 2(A) and 2(B)
Figures 4, 5:
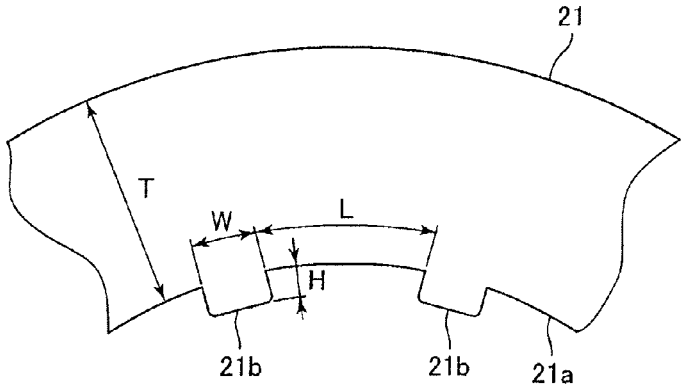
FIG. 4 is an enlarged view showing the "E" part in FIG. 3.
FIG. 5 is a table showing conditions and results when speed variation of a card is measured in the card reader shown in FIG. 1.

FIG. 2(A) is a perspective view showing the carrying roller 4 shown in FIG. 1 and FIG. 2(B) is an exploded perspective view showing the carrying roller 4 shown in FIG. 2(A). FIG. 3 is a side view showing a rubber ring 21 in FIGS. 2(A) and 2(B). FIG. 4 is an enlarged view showing the "E" part in FIG. 3.

The carrying roller 4 includes, as shown in FIGS. 2(A) and 2(B), a rubber ring 21 which is made of rubber and formed in a substantially cylindrical shape and which structures an outer peripheral side of the carrying roller 4, and a core member 22 which is disposed on an inner peripheral side of the rubber ring 21 and holds the rubber ring 21. In this embodiment, the rubber ring 21 is an outer peripheral member which structures the outer peripheral side of the carrying roller 4, and the core member 22 is a holding member which holds the rubber ring 21 as the outer peripheral member.

An inner peripheral face 21*a* of the rubber ring 21 is, as shown in FIG. 3 etc., formed with a plurality of protruded parts 21*b* having a substantially rectangular solid shape which are protruded toward an inner side in a radial direction. In this embodiment, twelve protruded parts 21*b* are formed on the inner peripheral face 21*a* with an equal angular pitch. Further, in this embodiment, each of the protruded parts 21*b* is formed over the entire region in the axial direction of the rubber ring 21. The height "H" in the radial direction of the protruded part 21*b* (see FIG. 4) is set to be 1/3.5 or less of the thickness "T" in the radial direction of a portion of the rubber ring 21 (see FIG. 4) where the protruded part 21*b* is not formed.

For example, when the outer diameter of the rubber ring 21 is 20 mm and the width (width in the direction perpendicular to the paper surface in FIG. 3) is 5 mm, the height "H" is 0.5 mm and the thickness "T" is 1.75 mm or 3.3 mm. In this case, for example, the width "W" in the circumferential direction of the protruded part 21*b* (see FIG. 4) is 1 mm and the distance "L" (see FIG. 4) is about 2.5 mm.

The core member 22 is, as shown in FIG. 2(B), is formed in a substantially cylindrical stepped shape, which is provided with a large diameter part 22*b* having an outer peripheral face 22*a* abutting with the inner peripheral face 21*a* of the rubber ring 21 and a small diameter part 22*c* having a diameter smaller than the large diameter part 22*b*. The core member 22 in this embodiment is formed, for example, of resin. In accordance with an embodiment of the present invention, the core member 22 may be formed of metal such as aluminum.

The outer peripheral face 22*a* is formed with a plurality of groove parts 22*d* which are recessed toward the inner side in the radial direction and extended in the axial direction. Each of the protruded parts 21*b* is engaged with each of the groove parts 22*d*. Therefore, the outer peripheral face 22*a* is formed with twelve groove parts 22*d* with an equal angular pitch. The groove parts 22*d* are formed over substantially the entire region in the axial direction of the large diameter part 22*b*. Further, a depth of the groove part 22*d* is set to be the same as the height "H" of the protruded part 21*b* or slightly larger than the height "H" of the protruded part 21*b*, and a width of the groove part 22*d* is set to be the same as the width "W" of the protruded part 21*b* or slightly larger than the width "W" of protruded part 21*b*.

An end part of the groove part 22*d* in the axial direction of the core member 22 is formed with a flange part 22*e* which is formed so as to extend toward an outer side in the radial direction and so as to be abutted with an end part of the rubber ring 21 (end part in the axial direction). Specifically, as shown in FIG. 2(B), in one of groove parts 22*d* adjacent to each other in the circumferential direction, the flange part 22*e* is formed on one end side in the axial direction (for example, rear side on the paper surface) and, in the other of the groove parts 22*d* adjacent to each other, the flange part 22*e* is formed on the other end side in the axial direction (for example, front side on the paper surface). In other words, when viewed in the axial direction, the flange parts 22*e* adjacent to each other in the circumferential direction are alternately formed on one end side and the other end side in the axial direction.

The rubber ring 21 is lightly press-fitted to the large diameter part 22*b* of the core member 22. Specifically, the rubber ring 21 is lightly press-fitted to the large diameter part 22*b* so that the inner peripheral face 21*a* and the outer peripheral face 22*a* are abutted with each other and the protruded parts 21*b* are engaged with the groove parts 22*d*. Further, the core member 22 is fixed to the rotation shaft for the carrying roller 4.

In this embodiment, the hardness of the rubber ring 21 single substance when measured by a durometer of type "A" specified in JISK6253 is about 65 degrees or about 75 degrees. Further, the hardness in the radial direction of the rubber ring 21 of the carrying roller 4 when measured by the durometer of type-"A" is in a range of about 67 degrees to 76 degrees.

Principal Effects in this Embodiment

As described above, in this embodiment, a plurality of protruded parts 21*b* is formed on the inner peripheral face 21*a* of the rubber ring 21 and a plurality of groove parts 22*d* which are engaged with the protruded parts 21*b* is formed on the outer peripheral face 22*a* of the core member 22. Therefore, a slip between the rubber ring 21 and the core member 22 is prevented by the protruded parts 21*b* and the groove parts 22*d*. Accordingly, in this embodiment, an adhering process in which the rubber ring 21 and the core member 22 are adhesively bonded with each other is not required and thus the carrying roller 4 is easily assembled.

Figure 7A:
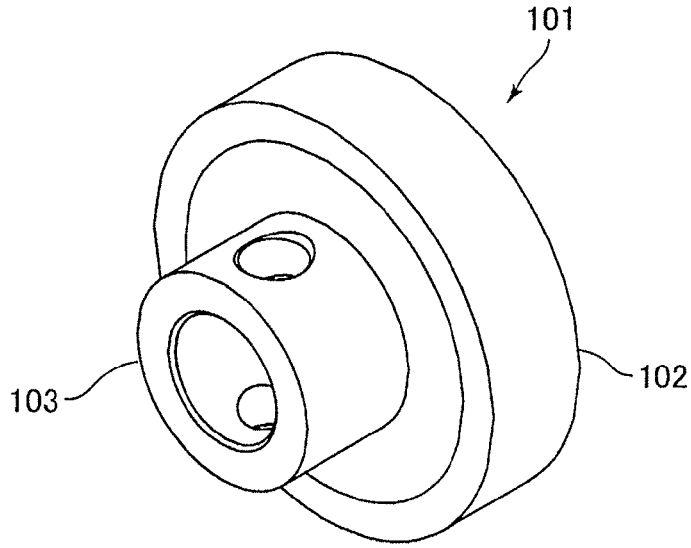
FIG. 7(A) is a perspective view showing a conventional carrying roller and FIG. 7(B) is an exploded perspective view showing the carrying roller shown in FIG. 7(A).
Figure 7B:
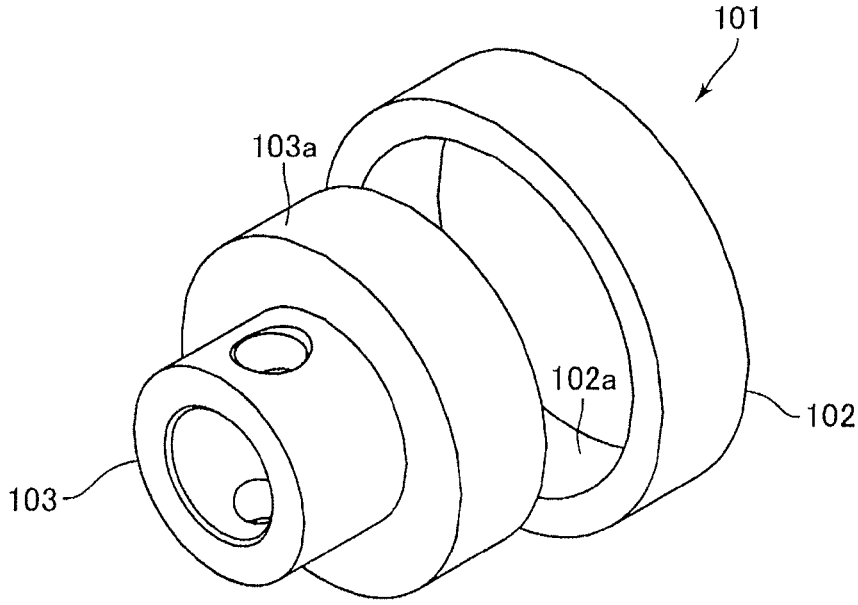

On the other hand, when the protruded parts 21*b* are formed on the inner peripheral face 21*a* of the rubber ring 21, a carrying speed of a card 2 which is carried through the carrying passage 8 is easily varied due to the protruded parts 21*b* and thus recording quality and reproduction quality of the card reader 1 may be deteriorated. However, in this embodiment, the height "H" in the radial direction of the protruded part 21*b* is set to be 1/3.5 or less of the thickness "T" of the rubber ring 21. Therefore, a speed variation amount of a card 2 is restrained to an extent which is near to a speed variation amount of a card 2 in a case that the carrying roller 101 as shown in FIGS. 7(A) and 7(B) is used as a reference carrying roller, which is provided with the rubber ring 102 having the smooth inner peripheral face 102*a* and made of rubber as a reference outer peripheral member and the core member 103 having the smooth outer peripheral face 103*a*, disposed on the inner peripheral side and holding the rubber ring 102 as a reference holding member, or the speed variation amount of the card 2 is restrained to the same extent as the speed variation amount of the card 2 in the case that the carrying roller 101 is used.

This effect will be described in detail below on the basis of experiment results. FIG. 5 is a table showing conditions and results when speed variations of a card 2 are measured in the card reader 1 shown in FIG. 1.

Conditions of five patterns for the carrying roller are set as shown in FIG. 5 wherein variables are a shape of the inner peripheral face of the rubber ring, a thickness of the rubber ring, a height of the protruded part when the protruded part is formed on the inner peripheral face of the rubber ring, and a hardness in the radial direction of the carrying roller when measured by a durometer of type-"A". The carrying rollers which are set in the conditions 1 through 3 are the carrying roller 4 used in this embodiment, and the carrying roller which is set in the condition 5 is a carrying roller that is similar to the carrying roller 101 as a reference carrying roller. Further, the carrying roller which is set in the condition 4 is a carrying roller as a comparison example.

In each of the conditions, the outer diameter of the carrying roller is 20 mm. Further, when the protruded parts are formed on the inner peripheral face of the rubber ring, twelve protruded parts are formed in a substantially rectangular solid shape on the inner peripheral face of the rubber ring with an equal angular pitch. In addition, in the conditions 1 through 3 where the protruded parts are formed on the inner peripheral face of the rubber ring, the width in the circumferential direction of the protruded part is 1 mm and, in the condition 4, the width in the circumferential direction of the protruded part is 2 mm. Further, the hardness of the rubber ring single substance when measured by a durometer of type-"A" is about 75 degrees in the condition 1 and about 65 degrees in the conditions 2 through 5.

As a result of the experiments, a speed variation amount of a card 2 (ratio of speed variation of a card 2 with respect to the reference carrying speed) in the card reader 1 using the carrying roller 101 which is set in the condition 5 is 4-6% (from 4% to 6%). Further, a speed variation amount of a card 2 in the card reader 1 using the carrying roller 4 which is set in the condition 1 is also 4-6% (from 4% to 6%). In addition, a speed variation amount of a card 2 in the card reader 1 using the carrying roller 4 which is set in the condition 2 is 5-8% (from 5% to 8%), and a speed variation amount of a card 2 in the card reader 1 using the carrying roller 4 set in the condition 3 is 5-7% (from 5% to 7%).

On the other hand, a speed variation amount of a card 2 in the card reader 1 using the carrying roller which is set in the condition 4 is 7-14% (from 7% to 14%), in which a thickness of the rubber ring (thickness in the radial direction of the portion where the protruded part is not formed) is 1.75 mm, the height of the protruded part is 1 mm and thus the height in the radial direction of the protruded part is larger than 1/3.5 of the thickness of the rubber ring.

As described above, when the shape of the carrying roller 4 is set so that the height "H" in the radial direction of the protruded part 21*b* is 1/3.5 or less of the thickness "T" of the rubber ring 21, a speed variation amount of a card 2 is restrained to an extent which is near to a speed variation amount of a card 2 when the carrying roller 101 is used, or restrained to the same extent as the speed variation amount of a card 2 when the carrying roller 101 is used. In other words, in this embodiment, even when a plurality of the protruded parts 21*b* is formed on the inner peripheral face 21*a* of the rubber ring 21, a speed variation amount of a card 2 is restrained to an extent which is near to a speed variation amount of a card 2 in a case that the carrying roller 101 in which its outer peripheral side is structured by using the rubber ring 102 whose inner peripheral face 102*a* is smooth is used or, the speed variation amount of the card 2 is restrained to the same extent as the speed variation amount of the card 2 in the case that the carrying roller 101 is used. As a result, in this embodiment, recording quality and reproduction quality of the card reader 1 can be secured.

In this embodiment, as understood from the experiment results, the speed variation amount of a card 2 is further restrained effectively when the carrying roller 4 set in the condition 1 is used, in which the height "H" of the protruded part 21*b* is set in ⅙ or less of the thickness "T" of the rubber ring 21 and, in addition, in a case that the hardness in the radial direction of the carrying roller 101 as shown in FIGS. 7(A) and 7(B) when measured by a durometer of type-"A" is set to be the reference hardness, the hardness in the radial direction of the carrying roller 4 is set to be substantially equivalent to the reference hardness.

In other words, a speed variation amount of a card 2 in the card reader 1 using the carrying roller 4, which is set in the condition 2 in which the thickness "T" of the rubber ring 21 is 1.75 mm, the height "H" of the protruded part 21*b* is larger than ⅙ of the thickness "T" of the rubber ring 21 and, in addition, the hardness in the radial direction of the carrying roller 4 when measured by a durometer of type-"A" is slightly lower than that in the condition 5, is slightly larger than the speed variation amount of a card 2 in the card reader 1 using the carrying roller 101 which is set in the condition 5. Further, a speed variation amount of a card 2 in the card reader 1 using the carrying roller 4, which is set in the condition 3 in which the thickness "T" of the rubber ring 21 is 3.3 mm, the height "H" of the protruded part 21*b* is less than ⅙ of the thickness of the rubber ring 21, but the hardness in the radial direction of the carrying roller 4 when measured by a durometer of type-"A" is lower than that in the condition 5, is slightly larger than the speed variation amount of a card 2 in the card reader 1 using the carrying roller 101 which is set in the condition 5.

On the other hand, a speed variation amount of a card 2 in the card reader 1 using the carrying roller 4, which is set in the condition 1 in which the thickness "T" of the rubber ring 21 is 3.3 mm, the height "H" of the protruded part 21*b* is less than ⅙ of the thickness "T" of the rubber ring 21 and, in addition, the hardness in the radial direction of the carrying roller 4 when measured by a durometer of type-"A" is substantially equivalent to that in the condition 5, is 4-6%, i.e., the same extent to the speed variation amount of a card 2 in the card reader 1 using the carrying roller 101 which is set in the condition 5.

As described above, when the carrying roller 4 is formed so that the height "H" in the radial direction of the protruded part 21*b* is set to be ⅙ or less than the thickness "T" of the rubber ring 21 and, in addition, when the hardness in the radial direction of the carrying roller 4 when measured by a durometer of type-"A" is set to be substantially equivalent to the reference hardness which is the hardness in the radial direction of the carrying roller 101 as the reference carrying roller when measured by a durometer of type-"A", a speed variation amount of a card 2 is restrained to the same extent as the speed variation amount of a card 2 when the carrying roller 101 is used. As a result, recording quality and reproduction quality with the same extent as the conventional example can be secured in the card reader 1.

In this embodiment, for example, the thickness "T" of the rubber ring 21 is 1.75 mm or 3.3 mm and the distance "L" in the circumferential direction between the protruded parts 21*b* is about 2.5 mm. However, it is preferable that the distance "L" is smaller than the thickness "T". When the distance "L" is smaller than the thickness "T", a slip between the rubber ring 21 and the core member 22 is prevented further surely by the protruded parts 21*b* and the groove parts 22*d*. In other words, according to the experiments of the present inventors, in a case that the outer diameter of the rubber ring 21 is 20 mm, its width is 5 mm, the height "H" of the protruded part 21*b* is 0.5 mm, the thickness "T" of the rubber ring 21 is 3.3 mm, and the width "W" of the protruded part 21*b* is 1 mm, when the distance "L" between the protruded parts 21*b* is set to be 6 mm (in other words, when six protruded parts 21*b* are formed on the inner peripheral face 21*a* with an equal angular pitch), a slip occurs between the rubber ring 21 and the core member 22.

On the other hand, in a case that the outer diameter of the rubber ring 21 is 20 mm, its width is 5 mm, the height "H" of the protruded part 21*b* is 0.5 mm, the thickness "T" of the rubber ring 21 is 3.3 mm, and the width "W" of the protruded part 21*b* is 1 mm, when the distance "L" between the protruded parts 21*b* is set to be 2.5 mm (in other words, when twelve protruded parts 21*b* are formed on the inner peripheral face 21*a* with an equal angular pitch), a slip does not occur between the rubber ring 21 and the core member 22. Therefore, a slip between the rubber ring 21 and the core member 22 is prevented further surely through the protruded parts 21*b* and the groove parts 22*d* by means of that the distance "L" between the protruded parts 21*b* is set to be smaller than the thickness "T" of the rubber ring 21.

In this embodiment, the end part in the axial direction of the groove part 22*d* is formed with the flange part 22*e* which is abutted with the end part in the axial direction of the rubber ring 21. Therefore, displacement of the rubber ring 21 from the core member 22 in the axial direction is prevented. Accordingly, even when the rubber ring 21 and the core member 22 are not adhesively bonded to each other, reproduction quality and recording quality of magnetic information can be secured.

Especially, in this embodiment, when viewed in the axial direction, the flange parts 22*e* adjacent to each other in the circumferential direction are alternately formed on one end side and on the other end side in the axial direction. Therefore, when the core member 22 is manufactured by using a die, the structure of the die can be simplified and a manufacturing cost of the core member 22 can be reduced.

In a case that a friction coefficient of the surface of a card 2 has been lowered, the card 2 is further adequately carried in the card reader 1 using the carrying roller 4 which is set in the condition 1 in comparison with the card reader 1 using the carrying roller 101 which is set in the condition 5. The effect will be described below on the basis of the experiment results. FIGS. 6(A) and 6(B) are tables showing experiment results in which a card 2 is carried in the card reader 1 shown in FIG. 1 in a state that a friction coefficient of the surface of the card 2 is lowered.

An experimenter performed the following experiment 100 times; a card 2 where a friction coefficient of its surface is lowered is inserted into the card reader 1 from the card insertion and ejection part 7 and then the experimenter checks whether the inserted card 2 is carried in the card reader 1 and ejected from the card insertion and ejection part 7 or not. Further, in this experiment, when the inserted card 2 was not ejected ten times continuously (in other words, a card jam where a card 2 was jammed in the card reader 1 occurred ten times continuously), the experiment result was determined as "NG" and the experiment was ended.

Further, in the experiment, a friction coefficient of the surface of a card 2 was lowered as follows. In other words, the experimenter wets his or her fingers holding the card 2 with water before inserting the card 2 into the card reader 1 once in five times, or the experimenter puts his or her fingers holding the card 2 with hand cream before inserting the card 2 into the card reader 1 once in twenty times, or the experimenter puts his or her fingers holding the card 2 with hand cream before inserting the card 2 into the card reader 1 once in ten times.

In addition, two types, i.e., the model "X" and the model "Y" are used as the card reader 1 in this experiment. The model "X" and the model "Y" are different from each other in only a width of the magnetic head 3 in a short widthwise direction of the card 2 (perpendicular direction to the paper surface of FIG. 1) and other portions are structured substantially similarly. Specifically, a width of the magnetic head 3 in the model "X" is about ½ of a width of the magnetic head 3 in the model "Y". Further, in the model "X" and the model "Y", the carrying rollers 4 are disposed at a substantially center position in the short widthwise direction of the card 2. In addition, in the model "X" and the model "Y", a pad roller is disposed so as to face the magnetic head 3.

As results of the experiments, as shown in FIGS. 6(A) and 6(B), in the card reader 1 using the carrying roller 4 which is set in the condition 1, in both of the model "X" and the model "Y" and, even when a friction coefficient of the surface of a card 2 is lowered with the use of water and hand cream, a situation that the inserted card 2 is not ejected ten times continuously did not occur.

On the other hand, in the card reader 1 using the carrying roller 101 which is set in the condition 5, as shown in FIG. 6 (A), in the model "X", when a friction coefficient of the surface of a card 2 is lowered by hand cream, a situation occurred that the inserted card 2 is not ejected ten times continuously. Further, in the card reader 1 using the carrying roller 101 which is set in the condition 5, as shown in FIG. 6 (B), in the model "Y", in a case that the experimenter puts his or her fingers holding the card 2 with hand cream before inserting the card 2 into the card reader 1 once in ten times, a situation occurred that the inserted card 2 is not ejected ten times continuously.

As described above, in a case that a friction coefficient of the surface of a card 2 has been lowered, the card 2 is adequately carried in the card reader 1 using the carrying roller 4 which is set in the condition 1 in comparison with the card reader 1 using the carrying roller 101 which is set in the condition 5. This may be because that the thickness of the rubber ring 21 of the carrying roller 4 which is set in the condition 1 is thicker than the thickness of the rubber ring 102 of the carrying roller 101 which is set in the condition 5 and thus the deformed quantity of the rubber ring 21 is larger than the deformed quantity of the rubber ring 102 when abutted with the card 2 and, as a result, the card 2 can be adequately carried in the card reader 1 using the carrying roller 4 which is set in the condition 1.

Other Embodiments

Although the present invention has been shown and described with reference to specific embodiments, various changes and modifications will be apparent to those skilled in the art from the teachings herein.

In the embodiment described above, twelve protruded parts 21*b* are formed on the inner peripheral face 21*a* of the rubber ring 21 with an equal angular pitch. However, the number of the protruded parts 21*b* formed on the inner peripheral face 21*a* may be a plural number except twelve. Further, the protruded parts 21*b* may be formed with an unequal angular pitch. Further, each of the dimensions of the outer diameter and the width of the rubber ring 21, the height "H" of the protruded part 21*b*, the thickness "T" of the rubber ring 21, the width "W" in the circumferential direction of the protruded part 21*b*, and the distance "L" between the protruded parts 21*b* shown in the embodiment described above is only an example and thus the present invention is not limited to the dimensions in the embodiment described above.

In the embodiment described above, when viewed in the axial direction, the flange parts 22*e* which are adjacent to each other in the circumferential direction are alternately formed on one end side and the other end side in the axial direction. However, the present invention is not limited to this embodiment. For example, the flange parts 22*e* may be formed on both end sides of the groove part 22*d* in the axial direction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE SIGNS LIST

1 card reader
2 card

3 magnetic head
4 carrying roller
12 drive motor (drive source)
21 rubber ring (outer peripheral member)
21*a* inner peripheral face
21*b* protruded part
22 core member (holding member)
22*a* outer peripheral face
22*d* groove part
22*e* flange part
"H" height
"L" distance
"T" thickness

The invention claimed is:

1. A card reader comprising:

a carrying roller which is rotated by a drive force of a drive source to carry a card;

wherein the carrying roller comprises:

an outer peripheral member which is made of rubber and formed in a substantially cylindrical shape, and which structures an outer peripheral side of the carrying roller; and a holding member which is provided with an outer peripheral face that abuts with an inner peripheral face of the outer peripheral member, and which is disposed on an inner peripheral side of the outer peripheral member and holds the outer peripheral member;

wherein the inner peripheral face of the outer peripheral member is formed with a plurality of protruded parts which are protruded toward an inner side in a radial direction;

wherein the outer peripheral face of the holding member is formed with a plurality of groove parts which are recessed toward the inner side in the radial direction and engaged with the protruded parts; and wherein a height in the radial direction of each protruded part is set to be 1/3.5 or less of a thickness in the radial direction of a portion of the outer peripheral member where the protruded part is not formed.

2. The card reader according to claim 1;

wherein the height in the radial direction of the protruded part is set to be ⅙ or less of the thickness in the radial direction of the portion of the outer peripheral member where the protruded parts are not formed;

wherein, in a case that a hardness in the radial direction of a reference carrying roller when measured by a durometer of type-"A" specified in JISK6253 is set to be a reference hardness, a hardness in the radial direction of the carrying roller when measured by a durometer of type-"A" is substantially equivalent to the reference hardness; and wherein the reference carrying roller comprises:

a reference outer peripheral member which is made of rubber and formed in a cylindrical shape and which is provided with an inner peripheral face that is smooth and where no protruded part protruding toward the inner side in the radial direction is formed; and a reference holding member which is provided with an outer peripheral face that is smooth and abutted with the inner peripheral face of the reference outer peripheral member and that no groove part recessed toward the inner side in the radial direction is formed;

wherein the reference holding member is disposed on an inner peripheral side of the reference outer peripheral member and holds the reference outer peripheral member.

3. The card reader according to claim 1, further comprising:

a magnetic head which performs reproduction of magnetic information recorded on the card and/or performs recording of magnetic information to the card.

4. The card reader according to claim 1;

wherein a distance between the protruded parts in a circumferential direction of the outer peripheral member is smaller than the thickness in the radial direction of the portion of the outer peripheral member where the protruded part is not formed.

5. The card reader according to claim 1;

wherein an end part of the groove part in an axial direction of the holding member is formed with a flange part which is abutted with an end part in the axial direction of the outer peripheral member.

6. The card reader according to claim 5;

wherein one of the groove parts which are adjacent to each other in a circumferential direction of the holding member is formed with the flange part on one end side in the axial direction of the holding member; and wherein an other of the groove parts which are adjacent to each other is formed with the flange part on an other end side in the axial direction of the holding member.

* * * * *